US005411013A

United States Patent [19]

Kazen

[11] Patent Number: 5,411,013

[45] Date of Patent: May 2, 1995

[54] FLUE INSERT TO CONTROL EXHAUST GASES

[76] Inventor: Gaius D. Kazen, 4304 172nd St., Stanwood, Wash. 98292

[21] Appl. No.: 175,289

[22] Filed: Dec. 29, 1993

Related U.S. Application Data

[63] Continuation-in-part of Ser. No. 115,309, Aug. 31, 1993.

[51] Int. Cl.[6] ..... F23J 11/00

[52] U.S. Cl. ..... 126/307 R; 126/297; 122/155.2; 138/46

[58] Field of Search ..... 126/307 R, 312, 80, 126/99 R, 83, 296, 82, 294, 297, 292; 122/155.2; 366/336, 338; 138/46, 37, 38, 43, 46; 165/174, 901, 109.1

[56] References Cited

U.S. PATENT DOCUMENTS

| | | | |
|---|---|---|---|
| 600,910 | 3/1898 | Elmendorf | 126/297 |
| 799,120 | 9/1905 | Way | 126/297 |
| 1,332,746 | 3/1920 | Oberg | 122/155.2 |
| 4,953,535 | 9/1990 | Hagan | 126/297 |

FOREIGN PATENT DOCUMENTS

| | | | |
|---|---|---|---|
| 382436 | 10/1923 | Germany | 122/155.2 |
| 83265 | 11/1919 | Switzerland | 126/297 |

*Primary Examiner*—James C. Yeung
*Attorney, Agent, or Firm*—Jensen & Puntigam

[57] ABSTRACT

A flue insert (50) for insertion into a flue stack (12). The flue insert includes a sleeve (52) that is inserting into the stack so as to function as part of the stack. A vane (54) is disposed in the sleeve. One end of the vane is fixedly attached to the sleeve. The opposed end of the vane is adjustably attached to the sleeve so that after the insert is installed, the overall length of the vane can be selectively set.

9 Claims, 3 Drawing Sheets

FIG. 6
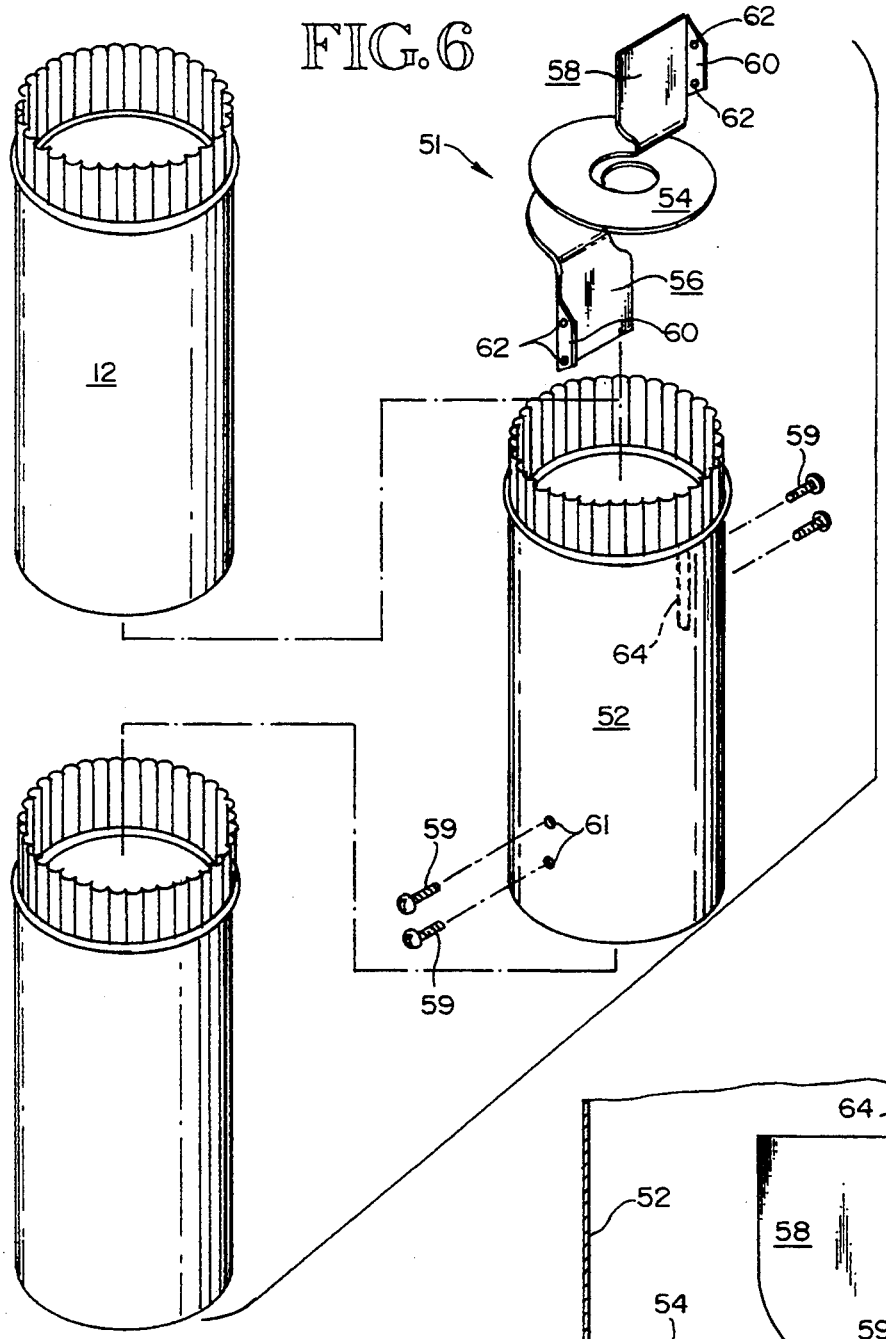
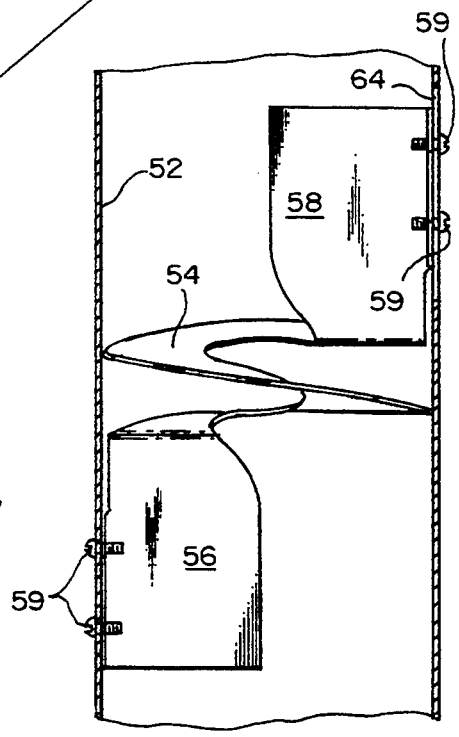
FIG. 7

FLUE INSERT TO CONTROL EXHAUST GASES

RELATIONSHIP TO OTHER APPLICATION

This application is a continuation-in-part of application Ser. No. 08/115,309 filed Aug. 31, 1993.

TECHNICAL FIELD

This invention relates generally to flue inserts for use in furnace and boiler chimneys and the like, and more particularly concerns a helical flue insert having an axial opening.

BACKGROUND OF THE INVENTION

It is well known that the efficiency of furnace/boiler systems is reduced by losses in the flue stack. These losses include losses in combustion efficiency, thermal efficiency and off-cycle efficiency. Combustion efficiency is reduced by excessive draft conditions through the flue, producing an excess oxygen condition of greater than 4%. In power boilers, maximum combustion efficiency will typically have oxygen levels of 2% to 4%. Excess draft also reduces thermal efficiency, which is the amount of energy used to accomplish a selected useful result rather than escaping through the flue. Off-cycle efficiency refers to the energy escaping through the flue stack between firing cycles.

Various attempts have been made to improve the overall efficiency of the furnace system directed toward the flue stack. These include preheaters, economizers, turbulators and various damping systems. Numerous systems attempt to improve efficiency by interrupting the exhaust gas flow up the stack in various ways. While this generally improves efficiency, the amount of restriction is limited, both practically and by regulation, since too severe a restriction will result in a dangerous furnace condition, including potentially an explosion.

One device which does restrict the flow of air and does improve efficiency to some extent is shown in U.S. Pat. No. 4,953,535, to Hagan. This device is a helical flue insert which has an adjustable pitch.

Still another limitation of many currently available restrictor assemblies is that they are difficult to set. As a result, adjusting the assembly in order to ensure that the assembly is properly adjusted in order to ensure that they impose the correct impedance of the gas flow out of the stack becomes a time consuming and expensive task.

The present invention also uses a helical restrictor element, but it is configured in such a way as to produce a further significant improvement in furnace efficiency. The present invention is also configured to provide a convenient means for adjusting the degree of impedance of the gas flow out of the stack.

SUMMARY OF THE INVENTION

Accordingly, the present invention is an apparatus for control of the flow of exhaust gases through a furnace flue system, comprising: a helical vane having an open center axial area, the helical vane extending for at least 360°, wherein the width of the vane is approximately one-third the diameter of the flue, and wherein the vane rotates counterclockwise from a furnace end of an exhaust flue, to the atmosphere; and means for mounting the helical vane within the flue, wherein the counterclockwise rotation of the vane opposes the natural helical flow of the exhaust gases, resulting in a reduced air flow through the flue.

Still another aspect of the present invention is that it includes: a first base plate attached to one end of the vane and securely attached to the associated flue; and a second base plate that is adjustably attached to the flue so that the overall length of the vane can be selectively set after it is installed in the flue.

BRIEF DESCRIPTION OF THE DRAWINGS

FIG. 6 is a an exploded view of an alternative flue insert of this invention.

FIG. 7 is cross-sectional view of the flue insert of FIG. 6.

BEST MODE FOR CARRYING OUT THE INVENTION

Figure 1:
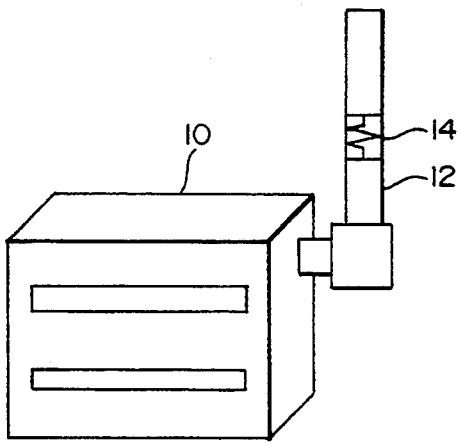
FIG. 1 is a simple schematic view of a furnace system and an associated flue stack showing the position of the insert of the present invention therein.

FIG. 1 shows a simple representation of a furnace system 10 and an associated flue stack 12. The furnace 10 is intended to represent any fuel-fired combustion heater, including water heaters, furnaces and boilers, among others. The exhaust gases, i.e. the products of combustion produced by the furnace, along with some of the heat produced, are exhausted to the atmosphere through flue stack 12. Flue stack 12 is also intended to be a general representation of a wide variety of exhausting systems. It could, for instance, include a draft inducer fan, various kinds of draft diverters, as well as various vent configurations and systems, including those systems which vent from the furnace into a chimney. The flue 12 could be round, square or rectangular in cross-section, as well as other shapes.

The present invention is a flue insert apparatus, shown generally at 14, which is positioned in flue stack 12. As will be described in more detail hereinafter, insert 14 can be positioned at various locations in flue stack 12, or on top of the flue stack, depending on the arrangement of the venting system.

Figure 2:
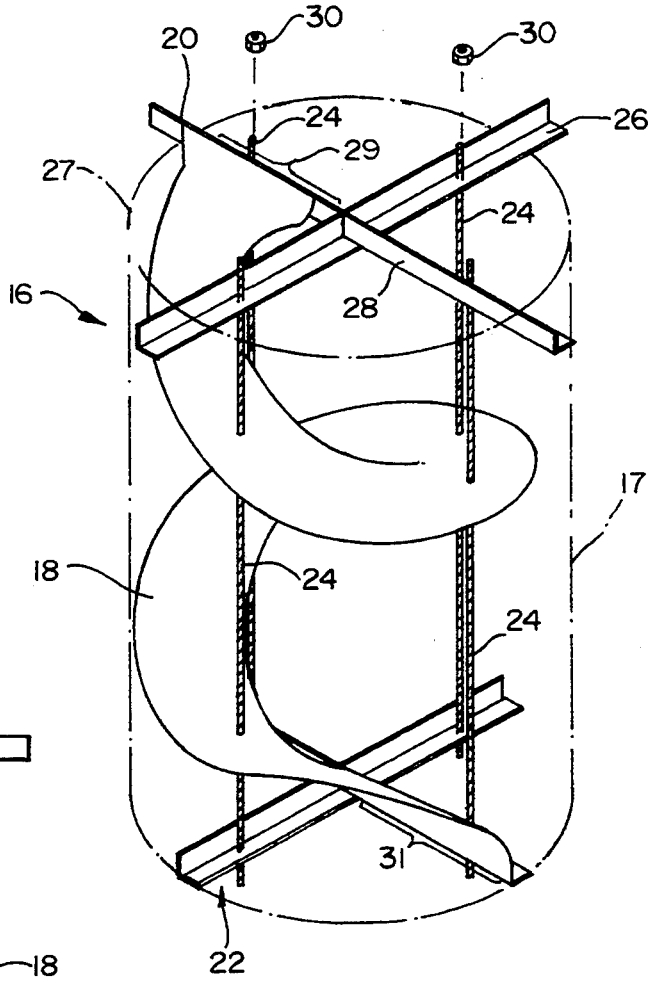
FIG. 2 is a perspective view of one embodiment of the present invention.
Figure 3:
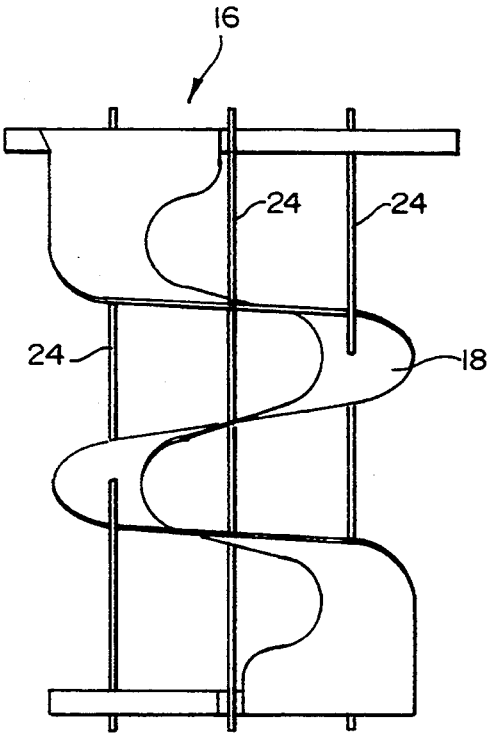
FIG. 3 is a side view of the embodiment of FIG. 2.

FIGS. 2 and 3 show one embodiment of the flue insert of the present invention. The insert 16 is adapted to be directly inserted into, i.e. "dropped in", the flue 17 (as shown in phantom) at the top end (exit) thereof. The top portion of the flue insert 16 is designed as explained below so that it is supported by the top edge of the flue 17 with the remainder of the insert being positioned interiorly of the flue.

The embodiment shown in FIGS. 2 and 3 includes a helical vane 18 and a frame assembly comprising upper and lower crossing brace assemblies 20 and 22, joined by four spaced threaded rods 24—24. Each crossing brace assembly, i.e. assembly 20, comprises two orthogonal L-shaped brace elements, e.g. 26 and 28. The brace elements 26 and 28 are, in the embodiment shown, made of stainless steel, ⅛ inch, or larger, thick. The brace elements are notched at the midpoints thereof and are fitted together and welded to form a unitary assembly. Since one of the elements is thus slightly raised relative to the other, that one element is slightly bent at the ends thereof, such that the respective ends of both elements are all in the same plane. The lower crossing brace assembly 22 is configured to fit just within the interior of the flue stack, while the upper crossing brace assembly 20 has slightly longer brace elements, so that the upper crossing brace assembly conveniently rests on the top edge 27 of the flue stack 17.

The helical vane in the embodiment shown extends from one half 29 of one of the brace elements, e.g. element 28, in the upper brace assembly down to the opposing half 31 of the coplanar brace element in the lower brace assembly. Intermediate of the two crossing brace assemblies, the helical vane 18 has openings to permit threaded rods 24 to extend therethrough as shown in FIGS. 2 and 3. In the embodiment shown, the threaded rods 24 are stainless steel, ⅜ inch, or larger, in diameter, and are threaded along their entire length. Conventional stainless steel nuts 30—30 establish the length of the insert.

In the embodiment shown, the helical vane 18 is of 20 gauge stainless steel, or heavier, depending on the flue size. The width of the vane is approximately one-third of the interior diameter of the flue, so for a 16-inch diameter flue, the vane would be approximately 5⅓ inches wide. This leaves an approximate 5⅓ inch wide opening along the center axis of the flue. The vane is arranged in a counter-rotation helix, i.e. the vane rotates counterclockwise when viewed from the furnace end toward the atmosphere end. This counter-rotation arrangement is quite significant. Previous helical vane flue inserts are clockwise in rotation, since this is the normal rotation of exhaust gases in a flue stack. However, by arranging the vane in a counterclockwise feature, turbulence of the exhaust gases is created, reducing straight-through air flow. The helical design itself slows down the flow of the flue stack exhaust gases, but the counter-rotation arrangement imparts an additional slowing action to the exhaust gas flow.

The counter-rotation vane changes the natural direction, i.e. rotation, of the gases and disrupts the laminar and smooth flow of the gases, slowing the flow of the gases through the flue. By forcing the gases to swirl or rotate opposite to their normal direction, the gas flow is retarded in all types of furnaces and boilers for widely varying operating conditions. The present invention thus in effect regulates the gas flow thermodynamically rather than mechanically. The flame in the fire tube increases in cross-section to nearly the full diameter of the tube, producing a significant increase in thermal efficiency. The counter-rotation vane arrangement thus provides a further increase in operational efficiency over the conventional helical design.

The angle or pitch of the helical vane 18 may be modified by simply rotating the two crossing brace assemblies relative to each other, and the length of the insert can be changed by moving the brace assemblies toward each other or away from each other along the threaded rods. Adjustment of the length changes the amount of helical surface within a specific distance. As indicated above, the plurality of nuts 30—30 sets the maximum length of the insert. The adjustment of pitch and length "fine tunes" the insert, i.e. the performance of the furnace is monitored while adjustments are made to pitch and length to achieve optimum performance. Typically, the total length of the insert is one and one-half to two times the diameter of the flue stack. In a "short" embodiment, the insert length is approximately equal to the diameter of the flue stack. This can of course be varied. In the embodiment shown, the vane has one and one-half complete turns, i.e. 540°, extending as indicated above, from one half 29 of brace element 20 to the opposing half 31 of the corresponding brace element at the other end of the insert.

Figure 4:
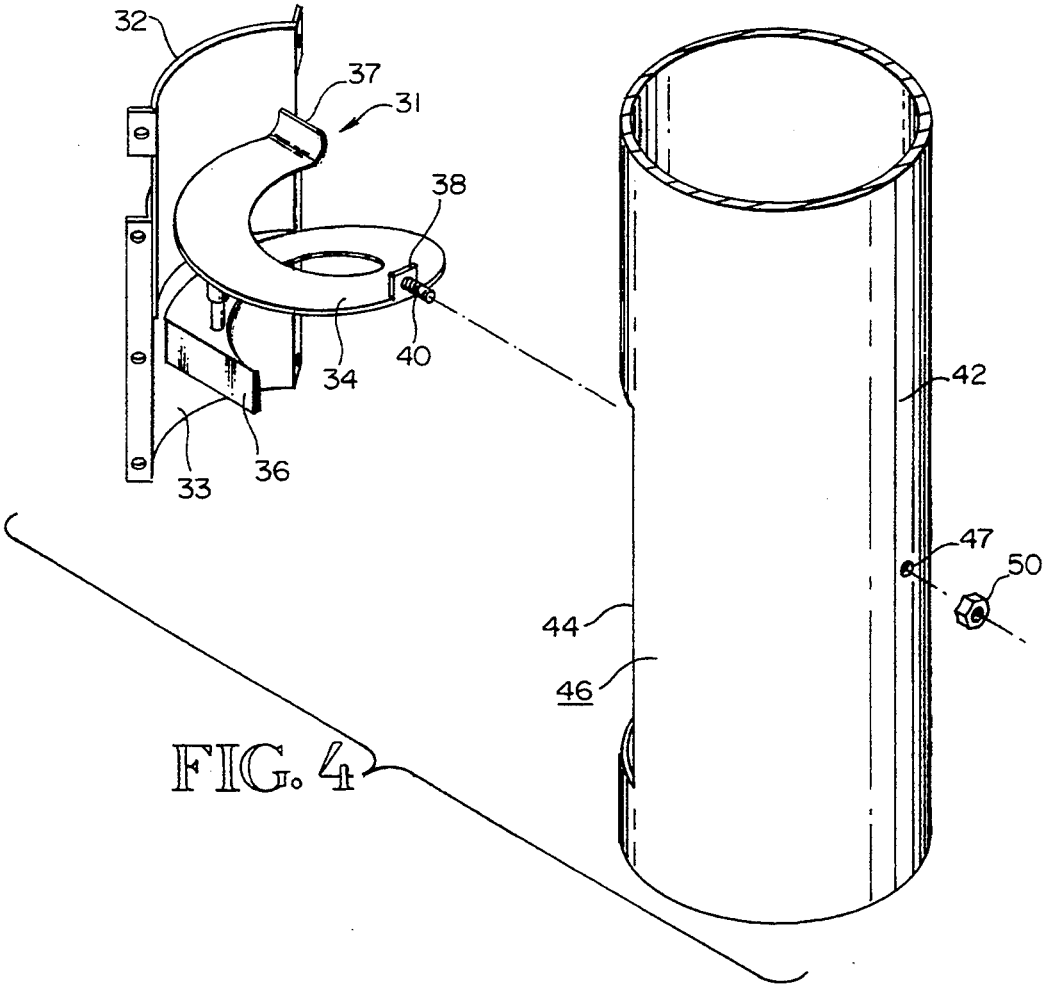
FIG. 4 is a schematic view of another embodiment of the flue insert of the present invention.
Figure 5:
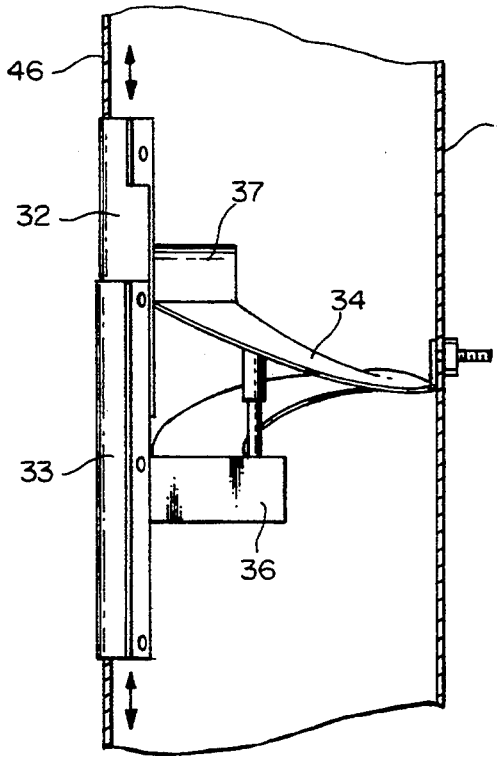
FIG. 5 is a cross-sectional view showing the mounting of the insert of FIG. 4 in a flue.

FIGS. 4 and 5 show a side mount embodiment. This embodiment is useful when it is either not practical or physically impossible to utilize the embodiment of FIGS. 2 and 3 or other similar configurations. The side mount insert 31 comprises two curved sections 32 and 33 which are positioned adjacent to each other and are connected so as to slide longitudinally relative to each other, in a telescoping arrangement. The two curved sections 32 and 33 have a curvature from side to side which matches the curvature of the flue wall. The sections themselves cover approximately 180° from side to side, one-half of the 360° circumference of the flue.

A helical vane 34 is connected at one end to one of the curved sections, and at the other end to the other curved section, typically by means of base plates such as that shown at 36 and 37 in FIGS. 4 and 5.

The pitch of the vane may be varied by moving the two curved sections 32 and 33 rotationally relative to each other. The length of the helix vane may be changed by moving the two sections longitudinally relative to each other. The helix vane 34 rotates counterclockwise like that of the embodiment of FIGS. 2 and 3. Typically, the vane 34 covers approximately 400° of rotation. A small ear portion 38 extends from vane 34 at the opposite edge thereof from curved sections 32 and 33. A short threaded stainless steel bolt 40 extends from ear 33 and is used to attach vane 34 directly to the flue stack 42 in which the insert is to be positioned.

To accomplish the mounting of the insert 32, an opening 44 is made in the side of flue stack 42. The opening extends for approximately 90° from side to side of the circumference of the flue stack. The insert 31 is rotated so that the vane fits into the flue stack through the opening 44 and then the insert is rotated again so that the inner surface of the curved portions 32 and 33 fit flush against the exterior surface 46 of the flue stack 42. The bolt 40 extends through an opening 47 in the opposite side of the flue stack, and the vane is secured by a nut 50 threaded onto the bolt 40.

The desired length and pitch for the vane is then obtained by moving the curved sections relative to each other. This is done, as discussed above, by monitoring performance while changing the length and pitch to achieve fine tuning of the operation of the insert. Once the correct pitch and length of the helical vane has been obtained for a particular installation, the curved sections 32 and 33 are fixed in position relative to each other and relative to the flue by means of four bands (not shown) which extend around the flue and press the sections against the flue when tightened with bolts or the like. Gases move through the insert in the flue stack. The counterclockwise arrangement of the helical vane causes turbulence of the exhaust gases, as explained above, by causing the gases to move (rotate) in a direction opposite to their natural direction, which slows the movement of the exhaust gas through the flue stack, resulting in an increase in the overall operating efficiency of the furnace.

There are other methods of mounting the insert in a flue stack beyond the embodiments discussed above. For instance, a complete section of the flue could be cut out and replaced by a telescoping insert in which a bottom portion of the insert is configured to fit over an adjacent flue section and the top portion of the insert is configured to fit inside of the adjacent flue section. The two portions of the insert are movable relative to each other to provide the proper pitch for the counter-rotation helix vane.

The counter-rotation helix insert of the present invention improves the efficiency of the furnace system. It improves combustion efficiency by regulating the amount of oxygen, ensuring that it stays with the acceptable range of 2%–4% for power boilers, and further ensures that for atmospheric (natural draft) furnaces and boilers, the draft hoods are 90% full. Also, a maximum useful heat transfer occurs in power boilers to the hot water or low/high pressure steam system and in atmospheric furnaces to the warm air ducts or other heating element. Both the thermal efficiency and off-cycle efficiency are also improved, with a reduced heat loss to the atmosphere.

The flue insert device of the present invention is not only effective but safe, inexpensive to manufacture, and requires little, if any, maintenance. It can be readily modified to accommodate a variety of flue configurations.

FIGS. 6 and 7 illustrate an alternative flue insert 51 of this invention secured in the flue stack 12. Flue insert 51 includes a sleeve 52 that is dimensioned to be coupled in line with the stack 12 into which the flue insert 51 of this invention is installed. A helical vane 54 that is shaped to have a counterclockwise rotation is disposed inside the sleeve 52. A first base plate 56 is attached to one end of the vane 54 and a second base plate 58 is attached to the opposed end of the vane. Separate flanges 60 are attached to the outer edges of each base plate 56 and 58 so as to press against the adjacent inside surface of the sleeve 52.

A first one of the base plates, in the illustrated version of the invention the lower base plate, base plate 56, is securely attached to the sleeve 52 by a pair of threaded fasteners 59. Specifically, fasteners 59 extend through concentric circular openings 61 and 62 formed, respectively, in the sleeve 52 and the flange 60. The opposed end of the vane 54 is secured to the sleeve 52 by a second set of threaded fasteners 59 that extends through the flange in the top base plate, base plate 58. This second set of fasteners extends through the openings 62 formed in the flange 60 and an elongated slot 64 formed in the side of the sleeve 52.

This embodiment of the invention allows the length of the vane 54 to be adjusted by the simple acts of loosening the threaded fasteners 59 that extend through slot 64, repositioning the top of vane, and resecuring the threaded fasteners. Thus, this embodiment of the invention provides a flue insert 51 that can be readily height adjusted without having to provide telescoping flue stack sections convenient that either partially or entirely surround the flue insert. One advantage of eliminating these overlapping flue stack sections is that it minimizes the cost of providing an adjustable length flue insert. Still another advantage of eliminating the overlapping flue sections is that it minimizes the effort required to provide the flue insert.

It should, of course, be recognized that modifications can be made to flue insert 51. In some versions of the invention it may be economical to eliminate the base plates attached to the opposed ends of the vane and directly attach the end of the vane to flue stack. In these versions of the invention flanges may attached to one or both ends of the vane to facilitate the coupling of the vane to the flue stack. Also, in some versions of the invention, it may be desirable to use alternative means such as welding to secure one end of the vane to the flue stack. Also, it may be desirable in some versions of the invention to have a laterally extending slot to which one end of the vane is attached. This would make it possible to adjust the pitch of the vane instead of or as well as its height.

Although a preferred embodiment has been described herein, it should be understood that various changes, modifications and substitutions may be made without departing from the spirit of the invention which is defined by the claims which follow.

I claim:

1. Apparatus for control of the flow of exhaust gases through a flue stack, the flue stack being connected to a furnace system and serving as a conduit through which gases are exhausted from the furnace system, said apparatus comprising:

a sleeve dimensioned to be coupled to the flue stack;

a helical vane disposed in said sleeve, said vane having first and second opposed ends; and first and second attachment assemblies for securing said opposed ends of said vane to said sleeve, at least one of said first and second attachment assemblies being configured to secure at least one of said opposed ends of said vane to said sleeve in a pluraity of positions of varying distance relative to the other end of said vane.

2. An apparatus of claim 1, further including a base plate attached to said second end of said vane, and wherein said second attachment assembly is secured to said base plate.

3. An apparatus of claim 2, wherein said second attachment assembly includes a longitudinally extending opening defined in said sleeve, and at least one releaseably securable fastener that extends through said sleeve opening and is attached to said base plate.

4. An apparatus of claim 1, wherein said second attachment assembly includes a longitudinally extending opening defined in said sleeve, and at least one releaseably securable fastener that extends through said sleeve opening and is attached to said second end of said vane.

5. An apparatus of claim 3, further including a base plate attached to said first end of said vane, wherein said vane first attachment assembly includes at least one fastener that extend through said sleeve into said base plate associated with said first end of said vane.

6. An apparatus of claim 1, wherein said vane is shaped to have an open center axial area, extends for at least 360°, has a width that is approximately one-third the diameter of said sleeve, and rotates in a counterclockwise pattern from said end of said sleeve directed toward said furnace system.

7. An apparatus of claim 3, wherein said vane is shaped to have an open center axial area, extends for at least 360°, has a width that is approximately one-third the diameter of said sleeve, and rotates in a counterclockwise pattern from said end of said sleeve directed toward said furnace system.

8. An apparatus of claim 5, wherein said vane is shaped to have an open center axial area, extends for at least 360°, has a width that is approximately one-third the diameter of said sleeve, and rotates in a counterclockwise pattern from said end of said sleeve directed toward said furnace system.

9. An apparatus of claim 1, wherein said first attachment assembly is configured to secure said first end of said vane to said sleeve in a fixed position and said second attachment assembly is configured to secure said second end of said vane to said sleeve in a pluraity of positions of varying distance relative to said fixed first end thereof.

* * * * *